US010590882B2

(12) United States Patent
Casasso et al.

(10) Patent No.: US 10,590,882 B2
(45) Date of Patent: Mar. 17, 2020

(54) FUEL INJECTOR CONTROL SYSTEMS AND METHODS

(71) Applicant: GM Global Technology Operations LLC, Detroit, MI (US)

(72) Inventors: Paolo Casasso, Turin (IT); Tiziana Belvedere, Turin (IT); Umberto Ferrara, Turin (IT); Luca Chiapusso, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 19 days.

(21) Appl. No.: 15/865,706

(22) Filed: Jan. 9, 2018

(65) Prior Publication Data

US 2019/0211772 A1 Jul. 11, 2019

(51) Int. Cl.

*F02D 41/40* (2006.01)
*F02D 41/38* (2006.01)
*F02D 41/20* (2006.01)
*F02D 41/30* (2006.01)

(52) U.S. Cl.

CPC ..... *F02D 41/401* (2013.01); *F02D 41/20* (2013.01); *F02D 41/30* (2013.01); *F02D 41/3809* (2013.01); *F02D 2041/2003* (2013.01); *F02D 2041/2013* (2013.01); *F02D 2041/2027* (2013.01); *F02D 2041/2058* (2013.01); *F02D 2200/503* (2013.01)

(58) Field of Classification Search

CPC .... F02D 41/401; F02D 41/3809; F02D 41/20; F02D 41/30; F02D 2041/2003

USPC ..... 123/490

See application file for complete search history.

(56) References Cited

U.S. PATENT DOCUMENTS

| | | | | |
|---|---|---|---|---|
| 8,694,228 | B2 * | 4/2014 | Kitamura | F02D 41/20 123/479 |
| 2009/0093944 | A1 * | 4/2009 | Sykes | F02D 41/2096 701/103 |
| 2009/0107469 | A1 * | 4/2009 | Takahashi | F02D 41/20 123/490 |
| 2009/0287393 | A1 * | 11/2009 | Moller | F02D 41/20 701/103 |
| 2010/0242920 | A1 * | 9/2010 | Omori | F02D 41/20 123/490 |
| 2018/0156148 | A1 * | 6/2018 | Nishimura | F02D 41/20 |

* cited by examiner

*Primary Examiner* — Mahmoud Gimie

(57) ABSTRACT

An injector driver module includes: a first node that is connected to a first terminal of a fuel injector; a first switch configured to, when closed, connect a first potential of a battery to the first node; a second switch configured to, when closed, connect a second potential that is greater than the first potential to the first node; a second node that is connected to a second terminal of the fuel injector; and a third switch configured to, when closed, connect a ground potential to the second node. A switch control module is configured to, starting at a target injecting timing for a fuel injection event of the fuel injector: maintain the third switch closed; and switch the second switch using a pulse width modulated (PWM) signal having (i) a duty cycle that is less than 100 percent and (ii) a predetermined frequency.

20 Claims, 5 Drawing Sheets

FUEL INJECTOR CONTROL SYSTEMS AND METHODS

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to internal combustion engines and more particularly to fuel injector control systems and methods for engines.

Air is drawn into an engine through an intake manifold. A throttle valve and/or engine valve timing controls airflow into the engine. The air mixes with fuel from one or more fuel injectors to form an air/fuel mixture. The air/fuel mixture is combusted within one or more cylinders of the engine. Combustion of the air/fuel mixture may be initiated by, for example, spark provided by a spark plug.

Combustion of the air/fuel mixture produces torque and exhaust gas. Torque is generated via heat release and expansion during combustion of the air/fuel mixture. The engine transfers torque to a transmission via a crankshaft, and the transmission transfers torque to one or more wheels via a driveline. The exhaust gas is expelled from the cylinders to an exhaust system.

An engine control module (ECM) controls the torque output of the engine. The ECM may control the torque output of the engine based on driver inputs and/or other inputs. The driver inputs may include, for example, accelerator pedal position, brake pedal position, and/or one or more other suitable driver inputs.

SUMMARY

In a feature a fuel injector control system of a vehicle is described. An injector driver module includes: a first node that is connected to a first terminal of a fuel injector; a first switch configured to: when closed, connect a first potential of a battery to the first node that is connected to the first terminal of the fuel injector; and when open, disconnect the first potential from the first node that is connected to the first terminal of the fuel injector; a second switch configured to: when closed, connect a second potential that is greater than the first potential to the first node that is connected to the first terminal of the fuel injector; and when open, disconnect the second potential from the first node that is connected to the first terminal of the fuel injector; a second node that is connected to a second terminal of the fuel injector; and a third switch configured to: when closed, connect a ground potential to the second node that is connected to the second terminal of the fuel injector; and when open, disconnect the ground potential from the second node that is connected to the second terminal of the fuel injector. A switch control module is configured to, starting at a target injecting timing for a fuel injection event of the fuel injector: maintain the third switch closed; and switch the second switch using a pulse width modulated (PWM) signal having (i) a duty cycle that is less than 100 percent and (ii) a predetermined frequency.

In further features, the switch control module is configured to determine the duty cycle that is less than 100 percent based on the predetermined frequency, a voltage between the second potential and the ground potential, and a target voltage for application to the fuel injector that is less than the voltage between the second potential and the ground potential.

In further features, the switch control module is configured to determine the duty cycle such that the second switch is closed for a period equal to:

$$\frac{Vtarget}{VBoost} * \frac{1}{f},$$

where Vtarget is the target voltage, VBoost is the voltage between the second potential and the ground potential, and f is the predetermined frequency.

In further features, the duty cycle is a predetermined value stored in memory.

In further features, the switch control module is configured to determine the duty cycle such that the second switch is closed for a period equal to:

$$\frac{Topen}{Ttarget} * \frac{1}{f},$$

where Topen is a first period to transition the fuel injector from closed to fully open via continuous connection of the second potential to the first node, Ttarget is a target period to transition the fuel injector from closed to fully open via application of the PWM signal to the second switch, and f is the predetermined frequency.

In further features, the switch control module is further configured to, after maintaining the third switch closed and switching the second switch using the PWM, open the first, second, and third switches.

In further features, the injector driver module further includes: a first diode connected between the first node that is connected to the first terminal of the fuel injector and the ground potential; and a second diode connected between the second node that is connected to the second terminal of the fuel injector and the second potential.

In further features, the injector driver module further includes: a third diode connected between the first node that is connected to the first terminal of the fuel injector and the first potential.

In further features, the switch control module is further configured to, after maintaining the third switch closed and switching the second switch using the PWM; maintain the third switch closed; and selectively switch the first switch.

In further features, the injector driver module further includes: a first diode connected between the first node that is connected to the first terminal of the fuel injector and the ground potential; a second diode connected between the second node that is connected to the second terminal of the fuel injector and the second potential; and a third diode connected between the first node that is connected to the first terminal of the fuel injector and the first potential.

In further features, the switch control module is configured to maintain the third switch closed and switch the second switch using the PWM signal until a current through the fuel injector is greater than a predetermined current.

In further features, the switch control module is further configured to, in response to a determination that the current through the fuel injector is greater than the predetermined current: open the first and second switches until the current through the fuel injector is less than or equal to a second predetermined current that is less than the predetermined current.

In further features, the switch control module is further configured to, in response to a determination that the current through the fuel injector is less than the second predetermined current: close the third switch and selectively close the first switch.

In further features, the switch control module is configured to, in response to the determination that the current through the fuel injector is less than the second predetermined current: close the third switch and switch the first switch using a PWM signal having the duty cycle that is less than 100 percent and the predetermined frequency.

In further features, the switch control module is configured to, in response to the determination that the current through the fuel injector is less than the second predetermined current: close the third switch and close the first switch until the current through the fuel injector is greater than or equal to a third predetermined current that is less than the predetermined current and greater than the second predetermined current.

In further features, the switch control module is configured to, in response to a determination that a predetermined period has passed after the determination that the current through the fuel injector is greater than the predetermined current: open the first and second switches until the current through the fuel injector is less than or equal to a fourth predetermined current that is less than the second predetermined current.

In further features, the switch control module is further configured to, in response to a determination that the current through the fuel injector is less than the fourth predetermined current: close the third switch and selectively close the first switch.

In further features, the switch control module is configured to, in response to the determination that the current through the fuel injector is less than the fourth predetermined current: close the third switch and switch the first switch using a PWM signal having the duty cycle that is less than 100 percent and the predetermined frequency.

In further features, the switch control module is configured to, in response to the determination that the current through the fuel injector is less than the fourth predetermined current: close the third switch and close the first switch until the current through the fuel injector is greater than or equal to a fifth predetermined current that is less than the second predetermined current and greater than the fourth predetermined current.

In a feature, a fuel injector control method for a vehicle includes: selectively closing a first switch and connecting a first potential of a battery to a first node that is connected to a first terminal of a fuel injector; selectively opening the first switch and disconnecting the first potential from the first node that is connected to the first terminal of the fuel injector; selectively closing a second switch and connecting a second potential that is greater than the first potential to the first node that is connected to the first terminal of the fuel injector; selectively opening the second switch and disconnecting the second potential from the first node that is connected to the first terminal of the fuel injector; selectively closing a third switch and connecting a ground potential to a second node that is connected to a second terminal of the fuel injector; selectively opening the third switch and disconnecting the ground potential from the second node that is connected to the second terminal of the fuel injector; and, starting at a target injecting timing for a fuel injection event of the fuel injector: maintaining the third switch closed; and switching the second switch using a pulse width modulated (PWM) signal having (i) a duty cycle that is less than 100 percent and (ii) a predetermined frequency.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts a mixture of air and fuel within cylinders to generate drive torque. A throttle valve regulates airflow into the engine. Fuel is injected by fuel injectors. Spark plugs may generate spark within the cylinders to initiate combustion. Spark plugs may be omitted in some types of engines, such as diesel engines. Intake and exhaust valves of a cylinder may be controlled to regulate flow into and out of the cylinder.

The fuel injectors receive fuel from a fuel rail. A high pressure fuel pump receives fuel from a low pressure fuel pump and pressurizes the fuel within the fuel rail. The low pressure fuel pump draws fuel from a fuel tank and provides fuel to the high pressure fuel pump. The fuel injectors inject fuel directly into the cylinders of the engine.

Power is applied to a fuel injector to open (e.g., a pintle or anchor of) the fuel injector. More specifically, a boosted voltage that is greater than a battery voltage is applied to the fuel injector to open the fuel injector. Power could be applied to the fuel injector until current through the fuel injector reaches a predetermined current where the fuel injector will be fully open. The fuel injector could be disconnected once a target mass of fuel has been injected. A greater amount of power than necessary to open the fuel injector may be applied, however, and the fuel injector may not fully close prior to the beginning of a next fuel injection event under some circumstances.

According to the present application, a fuel control module applies the boosted voltage to the fuel injector using a pulse width modulated (PWM) signal having a duty cycle of less than 100 percent. A target voltage that is less than the boosted voltage is therefore applied to the fuel injector. This provides a target profile of current through the fuel injector and achieves the predetermined current within a target period for opening the fuel injector.

Figure 1:
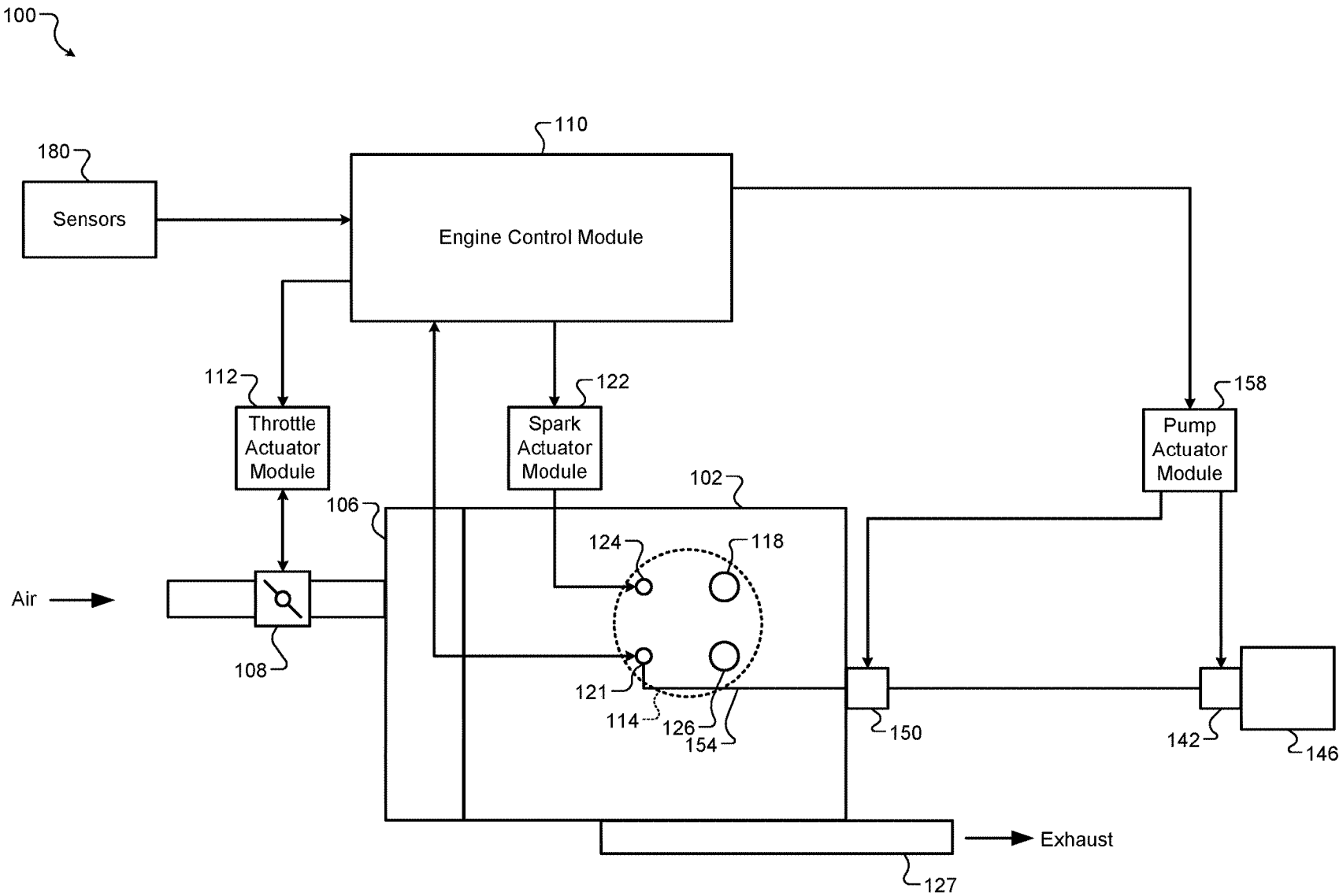
FIG. 1 is a functional block diagram of an example direct injection engine system.

Referring now to FIG. 1, a functional block diagram of an example engine system 100 is presented. The engine system 100 includes an engine 102 that combusts an air/fuel mixture to produce drive torque for a vehicle. While the engine 102 will be discussed as a spark ignition direct injection (SIDI) engine, the engine 102 may include another type of direct injection engine. One or more electric motors and/or motor generator units (MGUs) may be provided with the engine 102.

Air is drawn into an intake manifold 106 through a throttle valve 108. The throttle valve 108 may vary airflow into the intake manifold 106. For example only, the throttle valve 108 may include a butterfly valve having a rotatable blade. An engine control module (ECM) 110 controls a throttle actuator module 112 (e.g., an electronic throttle controller or ETC), and the throttle actuator module 112 controls opening of the throttle valve 108.

Air from the intake manifold 106 is drawn into cylinders of the engine 102. While the engine 102 may include more than one cylinder, only a single representative cylinder 114 is shown. Air from the intake manifold 106 is drawn into the cylinder 114 through an intake valve 118. One or more intake valves may be provided with each cylinder.

The ECM 110 controls fuel injection (e.g., amount and timing) into the cylinder 114 via a fuel injector 121. The fuel injector 121 injects fuel, such as gasoline or diesel fuel, directly into the cylinder 114. The fuel injector 121 is a solenoid type, direct injection fuel injector. Solenoid type, direct injection fuel injectors are different than port fuel injection (PFI) injectors and piezo electric fuel injectors. The ECM 110 may control fuel injection to achieve a desired air/fuel ratio, such as a stoichiometric air/fuel ratio. A fuel injector is provided for each cylinder.

The injected fuel mixes with air and creates an air/fuel mixture in the cylinder 114. Based upon a signal from the ECM 110, a spark actuator module 122 may energize a spark plug 124 in the cylinder 114. A spark plug may be provided for each cylinder. Spark generated by the spark plug 124 ignites the air/fuel mixture. Spark plugs may be omitted in some types of engines, such as diesel engines.

The engine 102 may operate using a four-stroke cycle or another suitable operating cycle. The four strokes, described below, may be referred to as the intake stroke, the compression stroke, the combustion stroke, and the exhaust stroke. During each revolution of a crankshaft (not shown), two of the four strokes occur within the cylinder 114. Therefore, two revolutions crankshaft are necessary for the cylinders to experience all four of the strokes.

During the intake stroke, air from the intake manifold 106 is drawn into the cylinder 114 through the intake valve 118. Fuel injected by the fuel injector 121 mixes with air and creates an air/fuel mixture in the cylinder 114. One or more fuel injections may be performed during a combustion cycle. During the compression stroke, a piston (not shown) within the cylinder 114 compresses the air/fuel mixture. During the combustion stroke, combustion of the air/fuel mixture drives the piston, thereby driving the crankshaft. During the exhaust stroke, the byproducts of combustion are expelled through an exhaust valve 126 to an exhaust system 127.

A low pressure fuel pump 142 draws fuel from a fuel tank 146 and provides fuel at low pressures to a high pressure fuel pump 150. While only the fuel tank 146 is shown, more than one fuel tank 146 may be implemented. The high pressure fuel pump 150 further pressurizes the fuel within a fuel rail 154. The fuel injectors of the engine 102, including the fuel injector 121, receive fuel via the fuel rail 154. Low pressures provided by the low pressure fuel pump 142 are described relative to high pressures provided by the high pressure fuel pump 150.

The low pressure fuel pump 142 may be an electrically driven pump. The high pressure fuel pump 150 may be a variable output pump that is mechanically driven by the engine 102. A pump actuator module 158 may control operation (e.g., output) of the high pressure fuel pump 150. The pump actuator module 158 controls the high pressure fuel pump 150 based on signals from the ECM 110. The pump actuator module 158 may also control operation (e.g., ON/OFF state) of the low pressure fuel pump 142.

The engine system 100 may include one or more sensors 180. For example, the sensors 180 may include one or more fuel pressure sensors, a mass air flowrate (MAF) sensor, a manifold absolute pressure (MAP) sensor, an intake air temperature (IAT) sensor, a coolant temperature sensor, an oil temperature sensor, a crankshaft position sensor, and/or one or more other suitable sensors.

Figure 2:
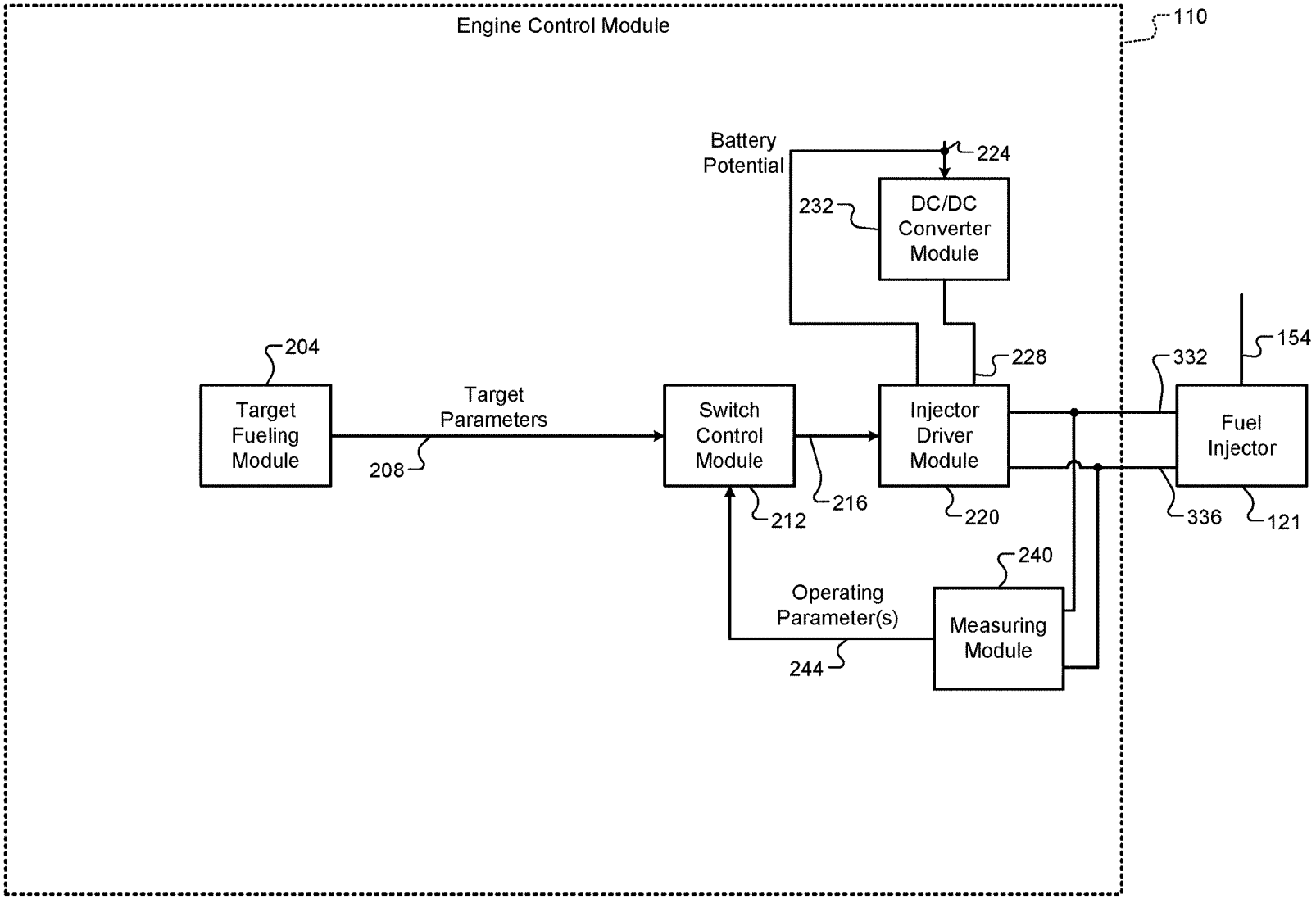
FIG. 2 is a functional block diagram of an example fuel control module of an engine control module.

Referring now to FIG. 2, a functional block diagram of an example fuel injector control system including an example portion of the ECM 110 is presented. A target fueling module 204 determines target fuel injection parameters 208 for a future (e.g., next) fuel injection event of the fuel injector 121. For example, the target fueling module 204 may determine a target mass of fuel for the fuel injection event and a target starting timing for the fuel injection event.

The target fueling module 204 may determine the target mass of fuel, for example, based on a target air/fuel ratio (e.g., stoichiometry) and an expected mass of air within the cylinder 114. The target fueling module 204 may determine the target mass of fuel further based on a predetermined fuel injection rate of the fuel injector 121 and a density of the fuel. The ECM 110 may determine the expected mass of air within the cylinder 114, for example, based on a mass air flowrate (MAF) of air into the engine 102 divided by the total number of (e.g., activated) cylinders of the engine 102. While only the target fuel injection parameters 208 for the future injection event is shown and discussed, multiple fuel injection events may be performed during a combustion cycle of the cylinder 114. The target fueling module 204 may determine the target fuel injection parameters 208 for each fuel injection event.

A switch control module 212 applies switch signals 216 to switches of an injector driver module 220 and controls switching of the switches. The switches of the injector driver module 220 control connection and disconnection of the fuel injector 121 to and from different reference potentials, such as a battery potential 224, a boost potential 228, and a ground potential, as discussed further below.

A direct current (DC) to DC converter module 232 receives the battery potential 224 and, from the battery potential 224, generates the boost potential 228 that is greater than the battery potential 224. For example only, the battery potential 224 may be approximately 12 volts, and the boost potential 228 may be approximately 50-65 volts or another suitable potential.

A measuring module 240 measures one or more operating parameters 244 of the fuel injector 121, such as current through the fuel injector 121, voltage applied to the fuel injector 121, and/or one or more other parameters.

Figure 3:
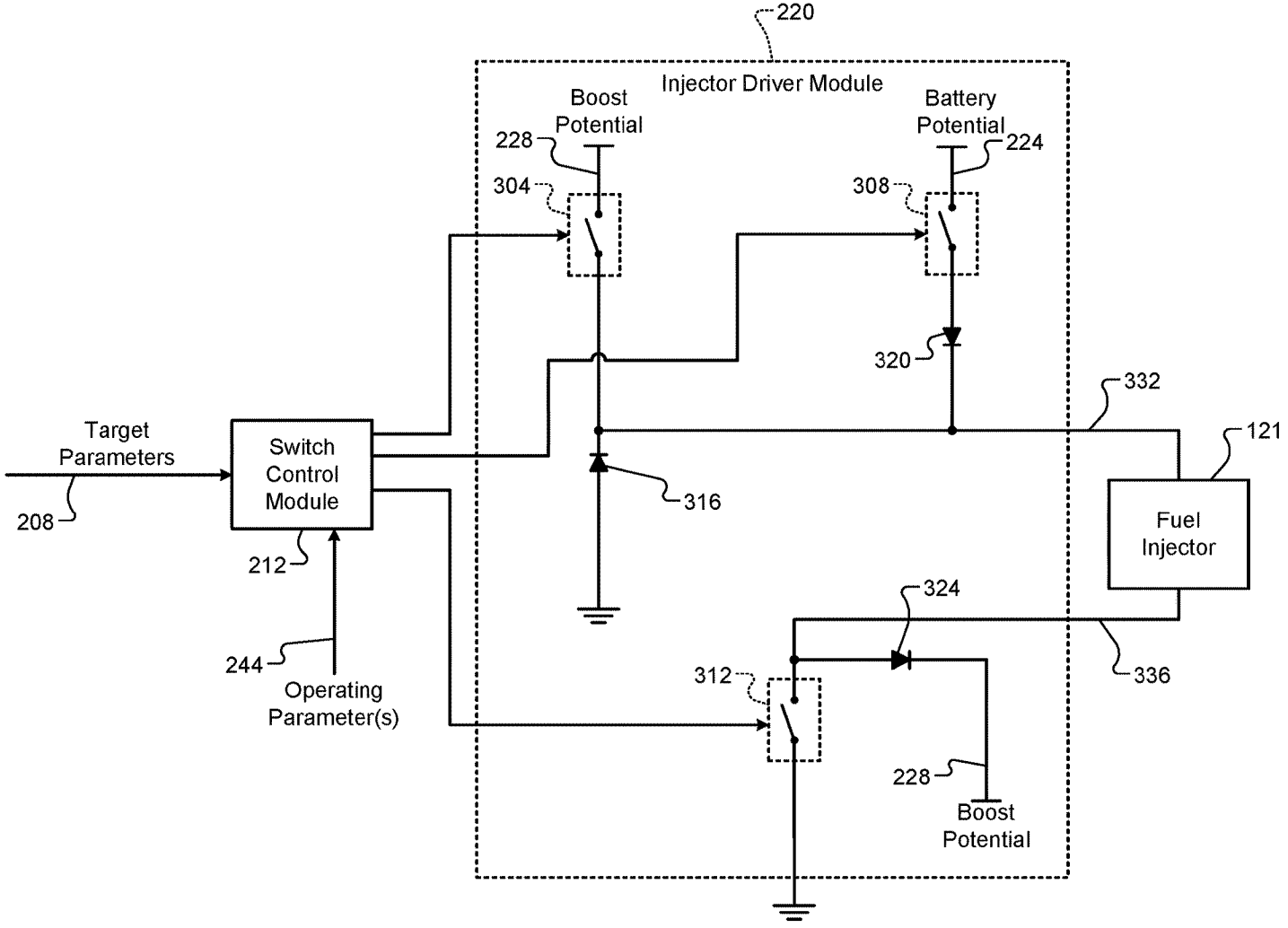
FIG. 3 is a functional block diagram including an example injector driver module.

FIG. 3 includes a block diagram including an example implementation of the switch control module 212, the injector driver module 220, and the fuel injector 121. The injector driver module 220 includes a first switch 304, a second switch 308, and a third switch 312. The injector driver module 220 also includes a first diode 316, a second diode 320, and a third diode 324.

A first end of the first switch 304 is connected to the boost potential 228. A second end of the first switch 304 is connected to a first node 332 that is connected to a first terminal (e.g., a high side) of the fuel injector 121. A cathode of the first diode 316 is connected to the first node 332, and an anode of the first diode 316 is connected to a ground potential.

A first end of the second switch 308 is connected to the battery potential 224. A second end of the second switch 308 is connected to an anode of the second diode 320. An anode of the second diode 320 is connected to the first node 332.

A first end of the third switch 312 is connected to a second node 336 that is connected to a second terminal (e.g., a low side) of the fuel injector 121. A second end of the third switch 312 is connected to the ground potential. A cathode of the third diode 324 is connected to the boost potential 228, and an anode of the third diode 324 is connected to the second node 336.

The first, second, and third switches 304, 308, and 312 may be, for example, field effect transistors (FETs), such as metal oxide semiconductor FETs (MOSFETs) or another suitable type of switch. The switch control module 212 control switching of the first, second, and third switches 304, 308, and 312 for each fuel injection event of the fuel injector 121.

At the target starting timing for a fuel injection event, the switch control module 212 closes the third switch 312 and applies a pulse width modulated (PWM) signal having a duty cycle and a predetermined frequency to the first switch 304. The duty cycle of a PWM signal may correspond to the percentage of a predetermined period (1/predetermined frequency) that the PWM signal is in a first state. The PWM signal is in a second state for a remainder of the predetermined period.

In various implementations, the switch control module 212 may determine the duty cycle for the PWM signal to apply to the first switch 304 based on the predetermined frequency and a target voltage that is less than the boost voltage (the boost potential relative to the ground potential). For example only, the target voltage may be 30 volts, 40 volts, or another voltage that is less than the boost voltage yet sufficient to transition the fuel injector 121 from closed to fully open in less than a predetermined opening period. The switch control module 212 may determine the duty cycle for the PWM signal, for example, using a lookup table or an equation that relates target voltages to duty cycles given the predetermined frequency.

As an example of an equation, the switch control module 212 may determine an ON period of the first switch 304 during each predetermined period using the equation:

$$Ton = \frac{Vtarget}{VBoost} * \frac{1}{f},$$

where Ton is the ON period, Vtarget is the target voltage, VBoost is the boost voltage, and f is the predetermined frequency. The switch control module 212 may determine the OFF period of the first switch 304 during each predetermined period using the equation:

$$Toff = \frac{1 - Vtarget}{VBoost} \times \frac{1}{f},$$

where Toff is the OFF period, Vtarget is the target voltage, VBoost is the boost voltage, and f is the predetermined frequency. Alternatively, the switch control module 212 may determine the OFF period of the first switch 304 during each predetermined period using the equation:

$$Toff = \frac{1}{f} - Ton,$$

In view of the above, the OFF period plus the ON period is equal to the predetermined period (1/the predetermined frequency).

The switch control module 212 sets a first signal applied to the first switch 304 to a first state continuously for the ON period during each predetermined period and to a second state continuously for the OFF period during each predetermined period. The first switch 304 closes when the first signal is in the first state, and the first switch 304 opens when the first signal is in the second state.

The switch control module 212 may apply the PWM signal having the duty cycle and the predetermined frequency to the first switch 304 until current through the fuel injector 121 is greater than the predetermined current. The fuel injector 121 is fully open when the current reaches the predetermined current.

As another example, the duty cycle may be a predetermined duty cycle stored in memory. The predetermined duty cycle may be calibrated to transition the fuel injector 121 from closed to fully open in less than the predetermined opening period.

As another example, the switch control module 212 may determine the ON period of the first switch 304 during each predetermined period using the equation:

$$Ton = \frac{Topen}{Ttarget} * \frac{1}{f},$$

where Ton is the ON period, Topen is the period to transition the fuel injector 121 from closed to fully open if the boost potential 228 was continuously applied to the fuel injector 121, Ttarget is a target period to transition the fuel injector 121 from closed to fully open via application of a PWM signal to the first switch 304, and f is the predetermined frequency. The switch control module 212 may determine the OFF period of the first switch 304 during each predetermined period using the equation:

$$Toff = \frac{Topen}{1 - Ttarget} * \frac{1}{f},$$

where Ton is the ON period, Topen is the period to transition the fuel injector 121 from closed to fully open if the boost potential 228 was continuously applied to the fuel injector 121, Ttarget is a target period to transition the fuel injector 121 from closed to fully open via application of a PWM signal to the first switch 304, and f is the predetermined frequency. Alternatively, the switch control module 212 may determine the OFF period of the first switch 304 during each predetermined period using the equation:

$$Toff = \frac{1}{f} - Ton,$$

where Toff is the OFF period, Ton is the ON period, and f is the predetermined frequency.

Figure 4:
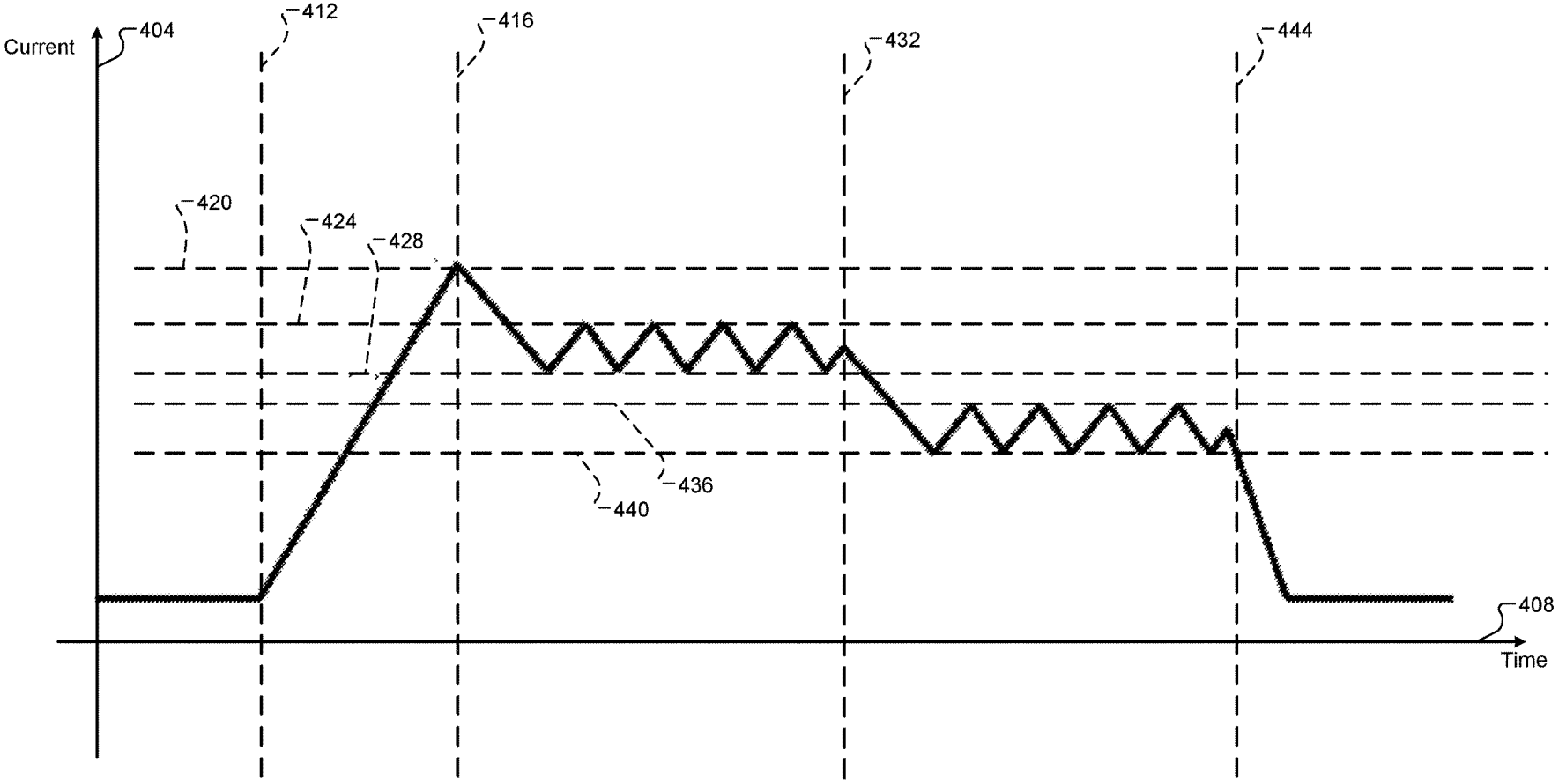
FIG. 4 is an example graph of current through a fuel injector for a fuel injection event.

FIG. 4 includes an example graph of current 404 through the fuel injector 121 versus time 408 during a fuel injection event. In the example of FIG. 4, the PWM signal having the duty cycle and the predetermined frequency is applied to the first switch 304 during a first period between times 412 and 416. Time 412 corresponds to the target starting timing for the fuel injection event. The fuel injector 121 is fully open by time 416. Line 420 represents an example of the predetermined current.

When the current has reached the predetermined current, the switch control module 212 stops applying the PWM signal having the duty cycle and the predetermined frequency to the first switch 304. The switch control module 212, however, maintains the third switch 312 closed. The switch control module 212 also selectively closes the second switch 308 during a second period of the fuel injection event.

The switch control module 212 may continuously close the second switch 308 during the second period until the current through the fuel injector 121 increases to equal to a second predetermined current that is less than the predetermined current. In another example, the switch control module 212 applies a PWM signal to the second switch 308 having the having the duty cycle and the predetermined frequency during the second period until the current through the fuel injector 121 increases to equal to the second predetermined current. When the current through the fuel injector 121 increases to equal to the second predetermined current, the switch control module 212 opens the second switch 308 until the current through the fuel injector 121 decreases to equal to a third predetermined current that is less than the second predetermined current.

In FIG. 4, lines 424 and 428 represent examples of the second and third predetermined currents, respectively. An example of the second period is between the time 416 and time 432. The second period is a predetermined period. The switch control module 212 transitions to a third period of the fuel injection event when the second period has passed after the start of the second period.

The switch control module 212 maintains the third switch 312 closed and selectively closes the second switch 308 during the third period of the fuel injection event. The third period follows the second period.

The switch control module 212 may continuously close the second switch 308 during the third period until the current through the fuel injector 121 increases to equal to a fourth predetermined current that is less than the third predetermined current. In another example, the switch control module 212 applies a PWM signal to the second switch 308 having the having the duty cycle and the predetermined frequency during the third period until the current through the fuel injector 121 increases to equal to the fourth predetermined current. When the current through the fuel injector 121 increases to equal to the fourth predetermined current, the switch control module 212 opens the second switch 308 until the current through the fuel injector 121 decreases to equal to a fifth predetermined current that is less than the fourth predetermined current.

In FIG. 4, lines 436 and 440 represent examples of the fourth and fifth predetermined currents, respectively. An example of the third period is between the time 432 and time 444. The third period is also a predetermined period. The switch control module 212 opens the first, second, and third switches 304, 308, and 312 when the third period has passed. The boost potential 228 is therefore applied to the second node 336, and the application of the boost voltage helps quickly close the fuel injector 121. As shown in FIG. 4, the current through the fuel injector 121 decreases.

Figure 5:
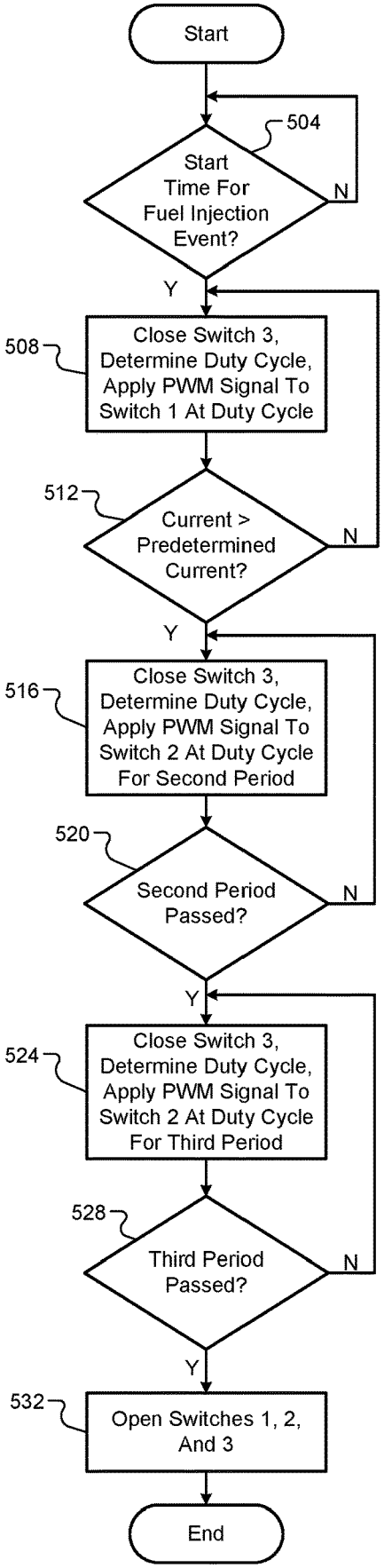
FIG. 5 is a flowchart depicting an example method of controlling application of power to a fuel injector for a fuel injection event.

FIG. 5 includes a flowchart depicting an example method of controlling application of power to the fuel injector 121 for a fuel injection event. Control begins with 504 where the switch control module 212 determines whether the target start timing (e.g., crankshaft position) has been reached for the fuel injection event. If 504 is true, control continues with 508. If 504 is false, control may remain at 504.

At 508, the switch control module 212 closes the third switch 312. The switch control module 212 also determines the duty cycle of the PWM signal to apply to the first switch 304 at 508, as discussed above. The duty cycle of the PWM signal is less than 100 percent. The switch control module 212 applies the PWM signal to the first switch 304 at the duty cycle and predetermined frequency. By applying the PWM signal to the first switch 304 at the duty cycle, a voltage that is less than the boost voltage is applied to the fuel injector 121.

At 512, the switch control module 212 determines whether the current through the fuel injector 121 is greater than the predetermined current. If 512 is true, control continues with 516. If 512 is false, control returns to 508 and continues the application of the PWM signal to the first switch 304.

At 516, the second period of the fuel injection event begins. The switch control module 212 maintains the third switch 312 closed. The switch control module 212 toggles between (i) applying a PWM signal at the duty cycle and the predetermined frequency to the second switch 308 until the current through the fuel injector 121 increases to the second predetermined current and (ii) maintaining the second switch 308 open until the current through the fuel injector 121 decreases to the third predetermined current. In various implementations, the duty cycle of the PWM signal applied to the second switch 308 may be 100 percent or another predetermined duty cycle, or the switch control module 212 may continuously apply the battery potential 224 to the first node 332 until the current through the fuel injector increases to the second predetermined current.

At 520, the switch control module 212 determines whether the second period has passed (since the first instance of 516). If 520 is true, control continues with 524. If 520 is false, control returns to 516. At 524, the third period of the fuel injection event begins. The switch control module 212 maintains the third switch 312 closed. The switch control module 212 toggles between (i) applying a PWM signal at a second duty cycle and the predetermined frequency to the second switch 308 until the current through the fuel injector 121 increases to the fourth predetermined current and (ii) maintaining the second switch 308 open until the current through the fuel injector 121 decreases to the fifth predetermined current. The second duty cycle of the PWM signal applied to the second switch 308 during the third period may be less than the duty cycle of the PWM signal applied to the second switch 308 during the second period.

At 528, the switch control module 212 determines whether the third period has passed (since the first instance of 524). If 528 is true, control continues with 532. If 528 is false, control returns to 524. At 532, the switch control module 212 opens the first, second, and third switches 304, 308, and 312. This applies the boost potential 228 to the second node 336, and the ground potential is connected to the first node 332. The application of the boost voltage to the fuel injector 121 closes the fuel injector 121. The magnitude of the boost voltage is greater than the magnitude of the voltage applied to the fuel injector 121 at 508. While control is shown and discussed as ending, the example of FIG. 5 is illustrative of one control loop and control may return to 504 for a next fuel injection event of the fuel injector 121. Also, a control loop is performed for each fuel injection event of each other fuel injector of the engine 102.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. A fuel injector control system of a vehicle, comprising:

an injector driver module that includes:

a first node that is connected to a first terminal of a fuel injector;

a first switch configured to:

when closed, connect a first potential of a battery to the first node that is connected to the first terminal of the fuel injector; and when open, disconnect the first potential from the first node that is connected to the first terminal of the fuel injector;

a second switch configured to:

when closed, connect a second potential that is greater than the first potential to the first node that is connected to the first terminal of the fuel injector; and when open, disconnect the second potential from the first node that is connected to the first terminal of the fuel injector;

a second node that is connected to a second terminal of the fuel injector; and a third switch configured to:

when closed, connect a ground potential to the second node that is connected to the second terminal of the fuel injector; and when open, disconnect the ground potential from the second node that is connected to the second terminal of the fuel injector;

a switch control module configured to, starting at a target injecting timing for a fuel injection event of the fuel injector:

maintain the third switch closed; and switch the second switch using a pulse width modulated (PWM) signal having (i) a duty cycle that is less than 100 percent and (ii) a predetermined frequency.

2. The fuel injector control system of claim 1 wherein the switch control module is configured to determine the duty cycle that is less than 100 percent based on the predetermined frequency, a voltage between the second potential and the ground potential, and a target voltage for application to the fuel injector that is less than the voltage between the second potential and the ground potential.

3. The fuel injector control system of claim 2 wherein the switch control module is configured to determine the duty cycle such that the second switch is closed for a period equal to:

$$\frac{Vtarget}{VBoost} * \frac{1}{f},$$

where Vtarget is the target voltage, VBoost is the voltage between the second potential and the ground potential, and f is the predetermined frequency.

4. The fuel injector control system of claim 2 wherein the duty cycle is a predetermined value stored in memory.

5. The fuel injector control system of claim 2 wherein the switch control module is configured to determine the duty cycle such that the second switch is closed for a period equal to:

$$\frac{Topen}{Ttarget} * \frac{1}{f},$$

where Topen is a first period to transition the fuel injector from closed to fully open via continuous connection of the second potential to the first node, Ttarget is a target period to transition the fuel injector from closed to fully open via application of the PWM signal to the second switch, and f is the predetermined frequency.

6. The fuel injector control system of claim 1 wherein the switch control module is further configured to, after maintaining the third switch closed and switching the second switch using the PWM signal, open the first, second, and third switches.

7. The fuel injector control system of claim 6 wherein the injector driver module further includes:

a first diode connected between the first node that is connected to the first terminal of the fuel injector and the ground potential; and a second diode connected between the second node that is connected to the second terminal of the fuel injector and the second potential.

8. The fuel injector control system of claim 7 wherein the injector driver module further includes:

a third diode connected between the first node that is connected to the first terminal of the fuel injector and the first potential.

9. The fuel injector control system of claim 1 wherein the switch control module is further configured to, after maintaining the third switch closed and switching the second switch using the PWM signal;

maintain the third switch closed; and selectively switch the first switch.

10. The fuel injector control system of claim 1 wherein the injector driver module further includes:

a first diode connected between the first node that is connected to the first terminal of the fuel injector and the ground potential;

a second diode connected between the second node that is connected to the second terminal of the fuel injector and the second potential; and a third diode connected between the first node that is connected to the first terminal of the fuel injector and the first potential.

11. The fuel injector control system of claim 1 wherein the switch control module is configured to maintain the third switch closed and switch the second switch using the PWM signal until a current through the fuel injector is greater than a predetermined current.

12. The fuel injector control system of claim 11 wherein the switch control module is further configured to, in response to a determination that the current through the fuel injector is greater than the predetermined current:

open the first and second switches until the current through the fuel injector is less than or equal to a second predetermined current that is less than the predetermined current.

13. The fuel injector control system of claim 12 wherein the switch control module is further configured to, in response to a determination that the current through the fuel injector is less than the second predetermined current:

close the third switch and selectively close the first switch.

14. The fuel injector control system of claim 13 wherein the switch control module is configured to, in response to the determination that the current through the fuel injector is less than the second predetermined current:

close the third switch and switch the first switch using a PWM signal having the duty cycle that is less than 100 percent and the predetermined frequency.

15. The fuel injector control system of claim 13 wherein the switch control module is configured to, in response to the determination that the current through the fuel injector is less than the second predetermined current:

close the third switch and close the first switch until the current through the fuel injector is greater than or equal to a third predetermined current that is less than the predetermined current and greater than the second predetermined current.

16. The fuel injector control system of claim 15 wherein the switch control module is configured to, in response to a determination that a predetermined period has passed after the determination that the current through the fuel injector is greater than the predetermined current:

open the first and second switches until the current through the fuel injector is less than or equal to a fourth predetermined current that is less than the second predetermined current.

17. The fuel injector control system of claim 16 wherein the switch control module is further configured to, in response to a determination that the current through the fuel injector is less than the fourth predetermined current:

close the third switch and selectively close the first switch.

18. The fuel injector control system of claim 17 wherein the switch control module is configured to, in response to the determination that the current through the fuel injector is less than the fourth predetermined current:

close the third switch and switch the first switch using a PWM signal having the duty cycle that is less than 100 percent and the predetermined frequency.

19. The fuel injector control system of claim 18 wherein the switch control module is configured to, in response to the determination that the current through the fuel injector is less than the fourth predetermined current:

close the third switch and close the first switch until the current through the fuel injector is greater than or equal to a fifth predetermined current that is less than the second predetermined current and greater than the fourth predetermined current.

20. A fuel injector control method for a vehicle, comprising:

selectively closing a first switch and connecting a first potential of a battery to a first node that is connected to a first terminal of a fuel injector;

selectively opening the first switch and disconnecting the first potential from the first node that is connected to the first terminal of the fuel injector;

selectively closing a second switch and connecting a second potential that is greater than the first potential to the first node that is connected to the first terminal of the fuel injector;

selectively opening the second switch and disconnecting the second potential from the first node that is connected to the first terminal of the fuel injector;

selectively closing a third switch and connecting a ground potential to a second node that is connected to a second terminal of the fuel injector;

selectively opening the third switch and disconnecting the ground potential from the second node that is connected to the second terminal of the fuel injector; and starting at a target injecting timing for a fuel injection event of the fuel injector:

maintaining the third switch closed; and switching the second switch using a pulse width modulated (PWM) signal having (i) a duty cycle that is less than 100 percent and (ii) a predetermined frequency.

* * * * *